US007821473B2

(12) United States Patent
Justice et al.

(10) Patent No.: US 7,821,473 B2
(45) Date of Patent: Oct. 26, 2010

(54) GRADIENT INDEX LENS FOR MICROWAVE RADIATION

(75) Inventors: Bryan J. Justice, San Diego, CA (US); Vinh N. Nguyen, Durham, NC (US); David R. Smith, Durham, NC (US); Serdar H. Yonak, Ann Arbor, MI (US)

(73) Assignees: Toyota Motor Engineering & Manufacturing North America, Inc., Erlanger, KY (US); Duke University, Durham, NC (US)

( * ) Notice: Subject to any disclaimer, the term of this patent is extended or adjusted under 35 U.S.C. 154(b) by 552 days.

(21) Appl. No.: 11/748,551

(22) Filed: May 15, 2007

(65) Prior Publication Data

US 2008/0284668 A1 Nov. 20, 2008

(51) Int. Cl.
*H01Q 15/02* (2006.01)

(52) U.S. Cl. ..... 343/909; 343/700 MS

(58) Field of Classification Search ..... 343/753, 343/909, 895, 700 MS
See application file for complete search history.

(56) References Cited

U.S. PATENT DOCUMENTS

| | | | | |
|---|---|---|---|---|
| 4,482,513 | A | 11/1984 | Auletti | |
| 4,636,798 | A | 1/1987 | Seavey | |
| 6,660,193 | B2 | 12/2003 | Myhre | |
| 6,859,114 | B2 | 4/2004 | Elftheriades et al. | |
| 6,791,432 | B2 * | 9/2004 | Smith et al. | 333/99 S |
| 6,958,729 | B1 | 10/2005 | Metz | |
| 7,009,565 | B2 | 2/2006 | Pidwerbetsky et al. | |
| 7,205,941 | B2 * | 4/2007 | Wang et al. | 343/700 MS |
| 7,492,329 | B2 * | 2/2009 | Wang et al. | 343/909 |
| 7,522,124 | B2 * | 4/2009 | Smith et al. | 343/909 |
| 2003/0002045 | A1 | 1/2003 | Nemat-Nasser et al. | |
| 2006/0125681 | A1 | 6/2006 | Smith et al. | |
| 2006/0257090 | A1 | 11/2006 | Podolskiy et al. | |
| 2007/0014006 | A1 | 1/2007 | Tanaka et al. | |
| 2007/0065069 | A1 | 3/2007 | Bratkovski et al. | |

FOREIGN PATENT DOCUMENTS

| | | |
|---|---|---|
| CN | 1649208 | 8/2005 |
| JP | 4313014 | 11/1992 |
| RU | 2185647 | 7/2002 |
| WO | WO-2006/023195 | 3/2006 |

OTHER PUBLICATIONS

"Electric-field-coupled resonators for negative permittivity metamaterials", D. Schurig et al., Applied Physics Letters 88, 041109 (2006).
"Lossy compression", Wikipedia, the free encyclopedia, Mar. 30, 2007.

* cited by examiner

*Primary Examiner*—Michael C Wimer
*Assistant Examiner*—Kyana R Robinson
(74) *Attorney, Agent, or Firm*—Gifford, Krass, Sprinkle, Anderson & Citkowski, P.C.

(57) ABSTRACT

A gradient index lens for microwave radiation. The lens includes a plurality of electric field coupled resonators wherein each resonator has a resonant frequency. The resonators are arranged in a planar array having spaced apart side edges and spaced apart top and bottom edges. The resonant frequency of the resonators varies between at least two of the spaced edges of the array in accordance with the desired properties of the lens.

9 Claims, 4 Drawing Sheets

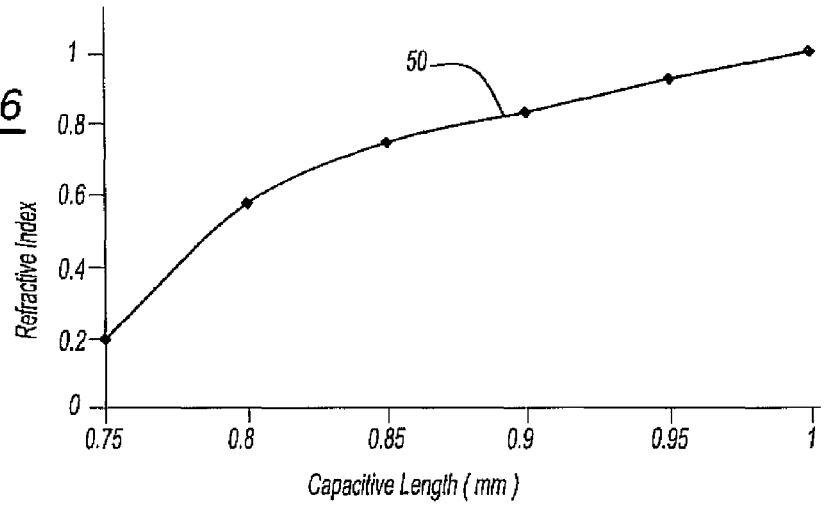
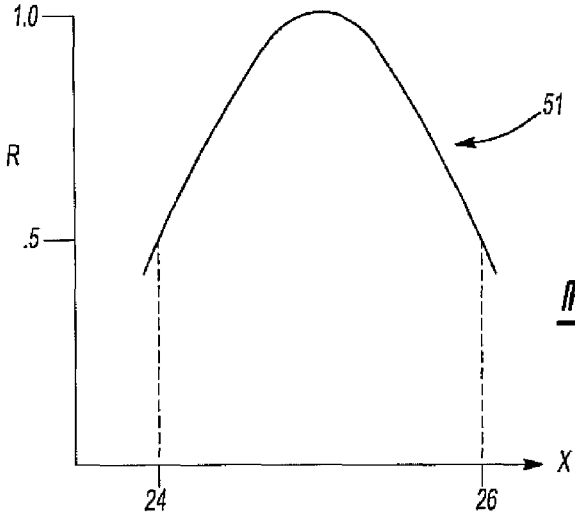
Fig-7
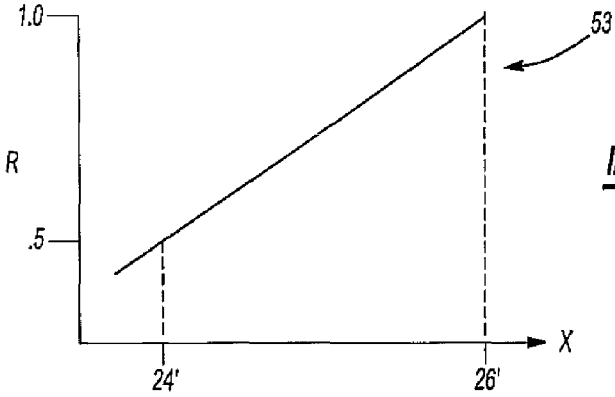
Fig-8

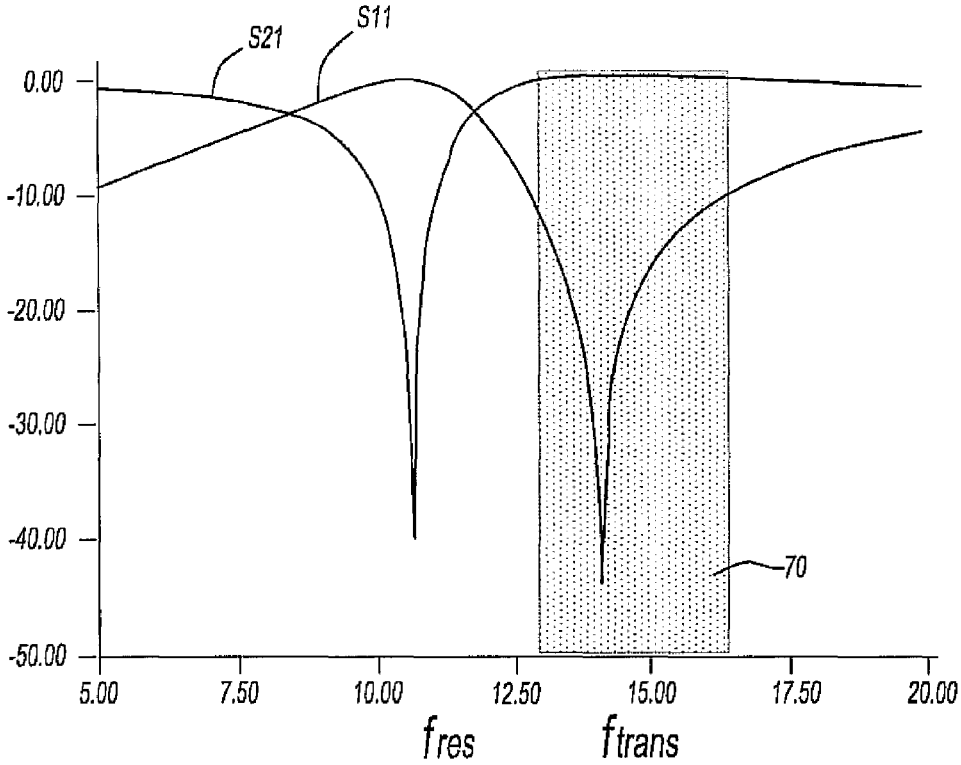
Fig-9
Fig-10
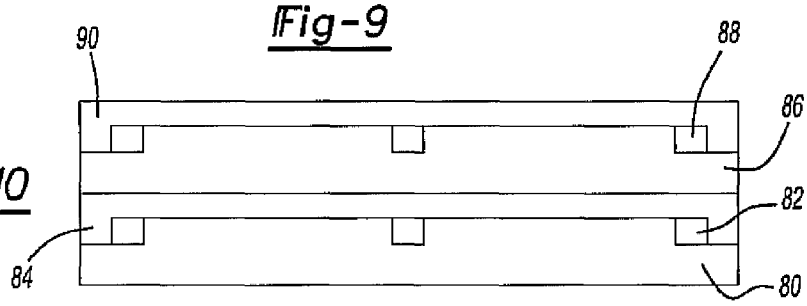
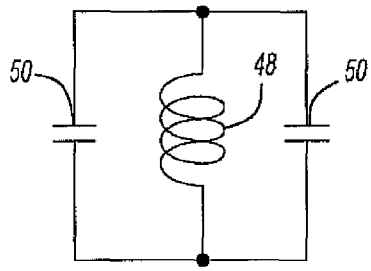
Fig-11

GRADIENT INDEX LENS FOR MICROWAVE RADIATION

BACKGROUND OF THE INVENTION

I. Field of the Invention

The present invention relates to microwave lenses and, more particularly, to a gradient index microwave lens which utilizes a plurality of electronic inductive capacitive resonators arranged in a planar array.

II. Description of Related Art

The field of metamaterials continues to grow in popularity. Such metamaterials exhibit properties in response to electromagnetic radiation which depends on the structure of the metamaterials, rather than their composition.

Most of the interest in metamaterials, however, has focused on metamaterials which exhibit a negative refractive index. Such a negative refractive index is possible where both the permittivity as well as the permeability of the material is negative.

One difficulty with negative index metamaterials, however, is that they are difficult to construct and also result in high attenuation of incident radiation. Furthermore, none of the previously known metamaterials have been employed for use with a gradient index lens for microwave radiation.

SUMMARY OF THE PRESENT INVENTION

The present invention provides a gradient index lens for microwave radiation which overcomes the above-mentioned disadvantages of the previously known devices.

In brief, the lens of the present invention comprises a plurality of electronic inductive capacitive (ELC) resonators, each of which has its own resonant frequency. The resonators are arranged in a planar array having spaced apart side edges and spaced apart top and bottom edges.

The resonant frequency of the resonators, and thus the refractive index, varies between at least two of the spaced apart sides of the array. For example, beam focusing may be achieved where the resonant frequency between two spaced apart edges varies in a parabolic fashion. Conversely, the variation of the resonant frequency in a linear fashion from one edge and to its spaced apart edge will result in beam bending or beam redirection.

Each ELC resonator includes both a substantially nonconductive substrate and a conductive pattern on one side of the substrate. The conductive pattern, furthermore, is arranged to respond to incident microwave radiation as an LC resonant circuit. At the resonant frequency, the resonator is substantially opaque to the incident radiation, but passes the radiation at a refractive index at a frequency offset from its resonant frequency.

In one form of the invention, at least one and preferably two elongated portions of the conductive strip on the substrate are spaced apart and parallel to each other to simulate a capacitor at the resonant microwave frequency. Thus, in order to change the resonant frequency of the ELC resonator, the length of the portion of the conductive pattern formed in the capacitor is either shortened or lengthened depending upon the desired end frequency for the resonator.

Preferably, metamaterials having a positive index of refraction is utilized for the ELC resonators. Such positive index material is not only easier to construct but results in less attenuation of the microwave radiation passing through the lens.

BRIEF DESCRIPTION OF THE DRAWING

A better understanding of the present invention will be had upon reference to the following detailed description when read in conjunction with the accompany drawing, wherein like reference characters refer to like parts throughout the several views, and in which:

FIG. 6 is a graph illustrating the refractive index as a function of the capacitive length for the ELC resonator;

FIG. 7 is a graph illustrating refractive error as a function of position on the lens illustrated in FIG. 1;

FIG. 8 is a view similar to FIG. 7, but illustrating the operation of the lens illustrated in FIG. 2;

FIG. 9 is a graph illustrating the S parameters for an exemplary ELC resonator;

FIG. 10 is a cross-sectional view illustrating an exemplary lens using micro-fabrication techniques; and FIG. 11 is a plan view illustrating an equivalent circuit for one ELC resonator.

DETAILED DESCRIPTION OF PREFERRED EMBODIMENTS OF THE PRESENT INVENTION

Figure 1:
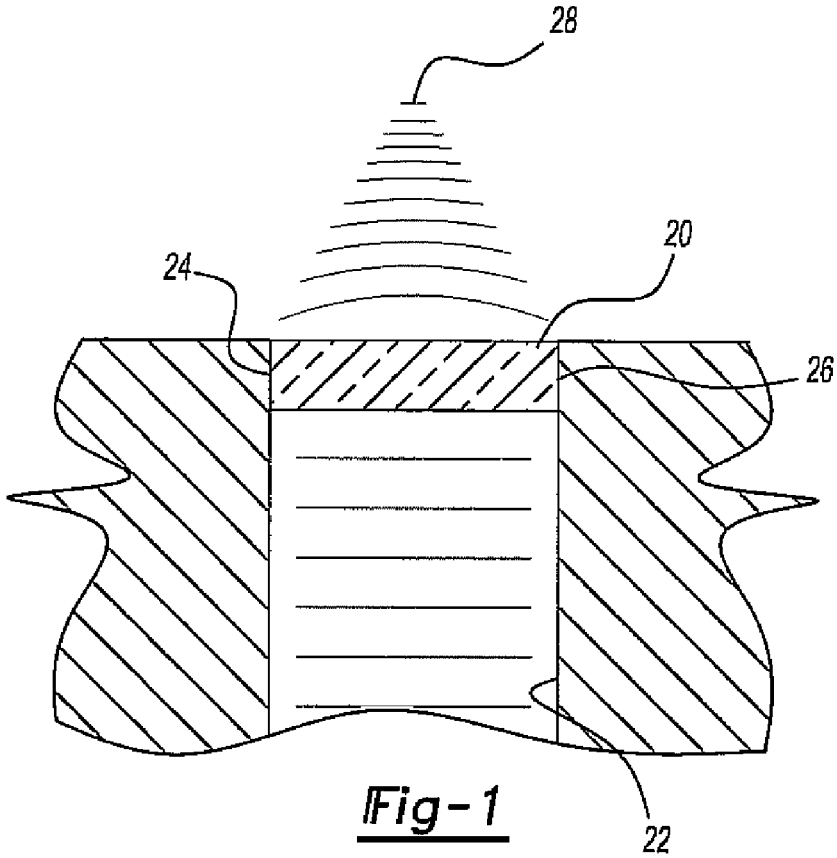
FIG. 1 is a top diagrammatic view illustrating the operation of one form of the present invention.

With reference first to FIG. 1, a gradient index lens 20 for microwave radiation is illustrated positioned at the end of a microwave guide 22. In a fashion that will be subsequently described in greater detail, the refractive index of the lens 20 varies in a parabolic fashion from one side edge 24 and to its other side edge 26. Consequently, assuming that the incident microwave radiation, i.e. radiation in the range of 300 megahertz to 300 gigahertz, impinges upon the lens 20, the refraction of the lens 20 will focus the radiation at point 28.

Figure 2:
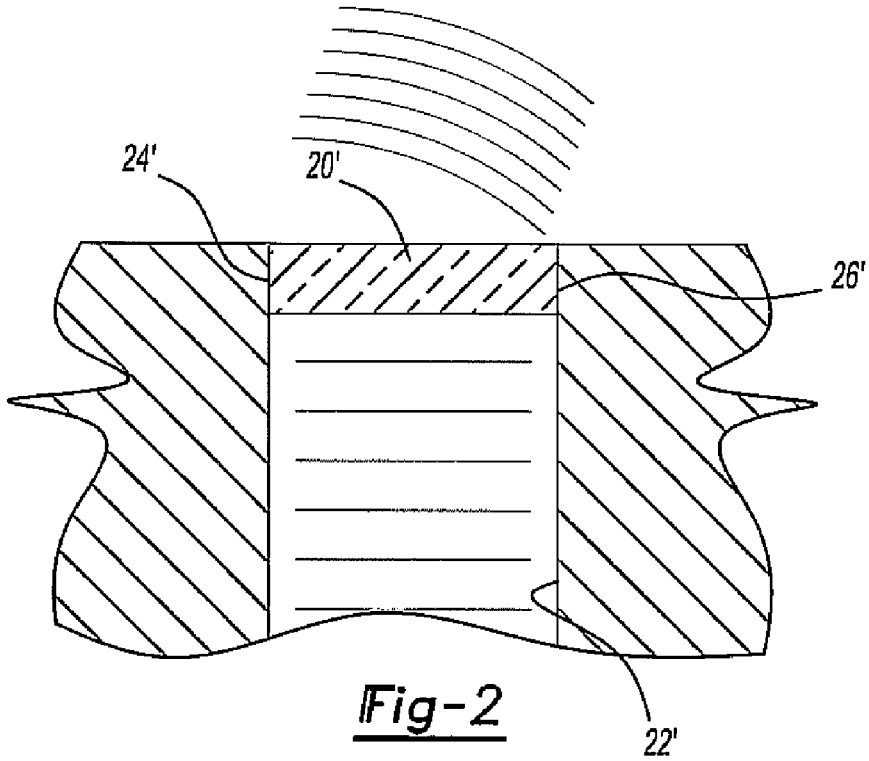
FIG. 2 is a view similar to FIG. 1, but illustrating a different operation of the present invention.

With reference now to FIG. 2, a modified form of the gradient index lens 20' is illustrated in which the index of refraction for the lens 20' varies linearly from one side edge 24' and to the other side edge 26' of the lens 20. Such a configuration for the lens 20' results in bending or redirection of the microwave beam passing through the microwave guide 22' and through the lens 20'.

The microwave lens 20 may, of course, be used in any microwave application where it is necessary to control beam focusing or beam direction of the microwave radiation. However, the lens 20 is preferably utilized in an automotive radar system having a microwave source of about 24 or 77 gigahertz or other frequencies that are allocated for such application.

Figure 3:
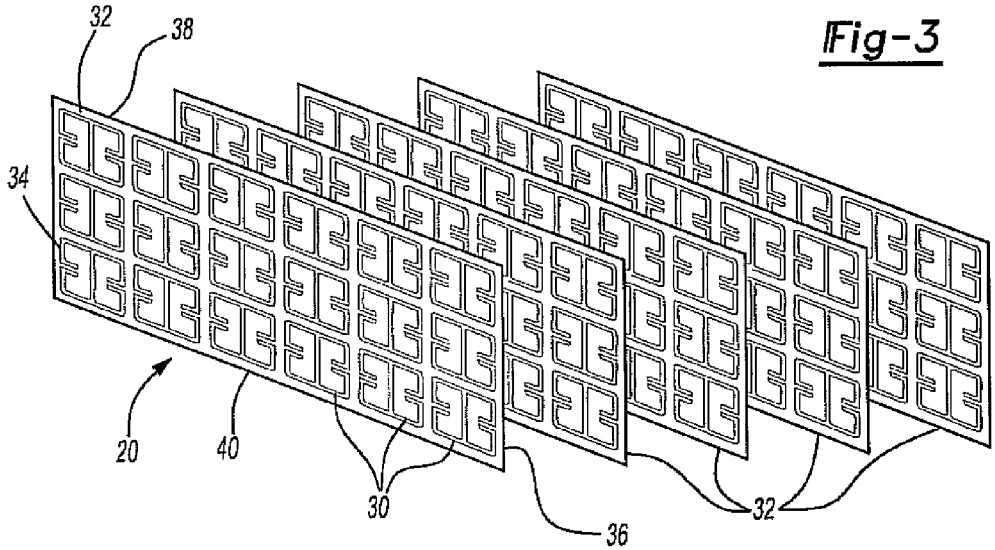
FIG. 3 is an exploded perspective view illustrating a preferred embodiment of the present invention.

With reference now to FIG. 3, the lens 20 comprises a plurality of electronic inductive capacitive (ELC) resonators 30 each of which are arranged in a planar array 32. Thus, the planar array 32 includes spaced apart side edges 34 and 36 as well as an upper edge 38 and lower edge 40. Although the planar array 32 is illustrated in FIG. 3 as being generally rectangular in shape, it will be understood that other shapes may be utilized without deviation from the spirit or scope of the invention.

Likewise, although the lens 20 of the present invention may comprise a single planar array 32 of the ELC resonators 30, two or even more planar arrays 32 may be positioned together in a stack to form a three-dimensional array. Each of the stacked planar arrays 32 are substantially identical to each other and as additional planar arrays 32 are stacked together, but spaced by a distance equal to the width of one ELC resonator 30, the refractive index of the lens 20 will increase accordingly. Consequently, the number of planar arrays 30 of the ELC resonators will vary depending upon the required focal or refractive properties for the lens 20 for the particular application.

Figure 4:
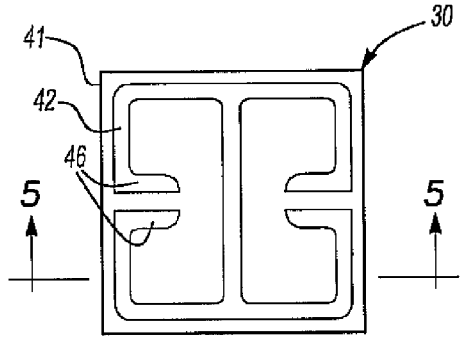
FIG. 4 is a plan view illustrating a single ELC resonator.
Figure 5:
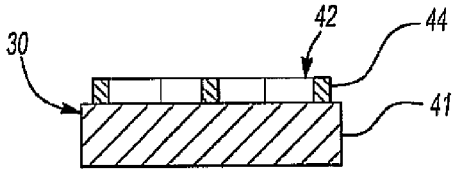
FIG. 5 is a view taken substantially along lines 5-5 in FIG. 4.

With reference now to FIGS. 4 and 5, one ELC resonator 30 is there shown in greater detail. The ELC resonator includes a substrate 41 which is generally rectangular in shape and constructed of a substantially nonconductive material. For example, the substrate 41 may be a non-conductive high-frequency laminate, Pyrex, fused silica, glass, or silicon based.

A pattern 42 formed from an electrically conductive foil is patterned on one side 44 of the substrate 41. This pattern 42, furthermore, includes at least one and preferably two portions 46 that are elongated and spaced apart and parallel to each other.

An equivalent electrical circuit for the resonator 30 is shown in FIG. 11 as a resonant LC circuit having an inductor 48 and two capacitors 50. The capacitors 50, furthermore, correspond to the portions 46 of the conductive foil pattern 42.

As is well known, the resonance of the LC resonant circuit illustrated in FIG. 6 may be varied by varying the value of the capacitors 50. Consequently, the resonant frequency of the ELC resonator 30 illustrated in FIG. 4 may be varied by varying the length of the portions 46 of the conductive foil pattern 42 which, in turn, varies the capacitance of the ELC resonator 30.

As the length of the foil portions 46 varies, thus varying the resonant frequency of the ELC resonator 30, the refractive index of the ELC 30 is likewise varied for a given fixed microwave frequency. For example, see FIG. 6 in which a graph of the refractive index for an ELC resonator 30 as a function of the length of the fail portions 46 from about 0.5 millimeters to about 1.0 millimeters is shown. The refractive index of the ELC resonator 30 in this example varies from approximately 0.2 to about 1.0.

In practice, the ELC should have a width of not more than one-sixth the microwave wavelength and, preferably, less than one-tenth of the microwave wavelength With reference now to FIG. 7, in order for the lens 20 to focus the beam to a point as shown in FIG. 1, the index of refraction, n, of the individual ELC resonators 30 illustrated at graph 51 should vary parabolically from one side 24 of the lens 20 and to its opposite side 26. The index of refraction is varied by varying the length of the capacitive portion 46 of the conductive foil pattern.

With reference now to FIG. 8, in order to achieve bending or redirection of the microwave beam as shown in FIG. 2, the index of refraction, n, is varied linearly as illustrated in graph 53 from one side edge 24' and to the opposite side edge 26' of the lens 20'. As before, the index of refraction is controlled by controlling the length of the capacitive portion 46 of the conductive foil pattern.

It will be understood, of course, that other types of manipulation of the microwave beam may be achieved by varying the index of refraction from one side edge and to the other side edge of the lens 20.

With reference now to FIG. 9, a graph of the S parameters for a single ELC resonator which has a resonant frequency of about 10.7 gigahertz at resonant frequency $f_{res}$, The graph of the parameter S21 representing the transmission of the microwave radiation through the lens thus reaches a minimum value at the resonant frequency $f_{res}$. Simultaneously, the reflected radiation S11 reaches a maximum value at the resonant frequency $f_{res}$. Consequently, at the resonant frequency of about 10.7 gigahertz, virtually no radiation is transmitted through the resonator 30.

Conversely, the reflected radiation graph S11 reaches a minimum at frequency $f_{trans}$ of about 14.2 gigahertz. At this time, the amount of radiation transmitted through the lens 20 not only reaches a maximum, but also forms a pass band 70 from about 13 gigahertz to about 16.5 gigahertz in which the transmitted radiation 21 is fairly constant. Consequently, as long as the lens 20 operates in the pass band 70 across the entire lens, minimal attenuation of the transmitted radiation can be achieved.

Preferably the lens 20 is utilized in automotive radar at a frequency of about 77 gigahertz so that the resonant frequency of any particular resonator 30 in the lens 20 will be somewhat less than 77 gigahertz or in the range of 40 to 60 gigahertz. Furthermore, for lenses used in the range of about 77 gigahertz, construction of the lens 20 may be achieved through micro-fabrication.

For example, with reference to FIG. 10, an exemplary fabrication of a lens for use with a 77 gigahertz microwave source is shown having a first substrate 80 and conductor 82 patterned on top of that substrate 80. The conductor pattern 82 is then optionally covered by a nonconductive layer 84.

Thereafter, this assembly can be stacked to make a lens or a second substrate 86, which is substantially the same as the first substrate 80, is placed on top of the nonconductive layer 84. A conductor 88, which is substantially the same as the conductor 82, is then deposited or patterned on top of the second substrate 86. A nonconductive coating 90 is then deposited over the conductive pattern 88 and the above process is repeated depending upon the number of desired layers in the lens 20.

Although the lens of the present invention has been described as a lens in which lens properties are fixed, no undue limitation should be drawn therefrom. Rather, the lens may be constructed as an active lens in which the refractive properties of the lens may be varied by MEMS, RF MEMS or other means to vary or tune the lens depending upon system requirements. For example, an active lens may be utilized in an automotive radar system to steer, zoom or otherwise control the projection of the radar beam.

From the foregoing it can be seen that the present invention provides a simple yet effective electromagnetic gradient index lens for microwave radiation. Since the lens utilizes an array of electronic inductive capacitive resonators, fabrication of the lens 20 may be achieved relatively simply. Furthermore, since the lens 20 exhibits a positive index of refraction, the previously known attenuation losses with negative index metamaterials is avoided.

Although the lens 20 has been described as a two-dimensional lens, it will be understood, of course, that the present invention may also operate as a three-dimensional lens in which the index of refraction varies not only between the two side edges of the lens, but also between the upper edge and lower edge of the lens.

Having described our invention, many modifications thereto will become apparent to those skilled in the art to which it pertains without deviation from the spirit of the invention as defined by the scope of the appended claims.

We claim:

1. A gradient index lens for microwave radiation comprising:

a plurality of electronic inductive capacitive resonators, each having a resonant frequency, said resonators being arranged in a planar array having a plurality of rows and columns with one resonator positioned at an intersection of each row and column, said rows extending between spaced apart side edges of said array, wherein the resonant frequency of adjacent resonators varies by a predetermined incremental amount sequentially from one side edge of said array to the other side edge of said array.

2. The lens as defined in claim 1 wherein the resonant frequency of said resonators varies between said spaced apart side edges of said array and spaced apart top and bottom edges of said array.

3. The lens as defined in claim 1 and comprising at least two substantially identical planar arrays of resonators, said arrays arranged in a spaced apart and parallel relationship to each other.

4. The lens as defined in claim 3 wherein said planar arrays are spaced apart from each other by an amount corresponding to a width of one resonator.

5. The lens as defined in claim 1 wherein each resonator is rectangular in shape having a width less than one-sixth the wavelength of the resonant frequency of the resonator.

6. The lens as defined in claim 1 wherein each resonator comprises at least one capacitor formed by two spaced apart and parallel conductive strips on a substrate, wherein the length of said conductive strips establishes the resonant frequency of the resonator.

7. The lens as defined in claim 2 and wherein each resonator comprises at least two capacitors, each capacitor formed by two spaced apart and parallel conductive strips on a substrate.

8. The lens as defined in claim 1 wherein said lens is utilized in an automotive radar system.

9. The lens as defined in claim 8 wherein said resonators have a pass band centered around resonant frequency in the range of 24 GHz-77 GHz.

* * * * *

UNITED STATES PATENT AND TRADEMARK OFFICE

CERTIFICATE OF CORRECTION

PATENT NO. : 7,821,473 B2
APPLICATION NO. : 11/748551
DATED : October 26, 2010
INVENTOR(S) : Bryan J. Justice et al.

It is certified that error appears in the above-identified patent and that said Letters Patent is hereby corrected as shown below:

Column 3, line 40 replace “fail” with --foil--

Signed and Sealed this
Twenty-sixth Day of July, 2011

David J. Kappos

David J. Kappos
*Director of the United States Patent and Trademark Office*